US011213080B2

(12) United States Patent
Henderson

(10) Patent No.: US 11,213,080 B2
(45) Date of Patent: Jan. 4, 2022

(54) SHAPE RETAINING FLAT-FOLD RESPIRATOR

(71) Applicant: 3M INNOVATIVE PROPERTIES COMPANY, St. Paul, MN (US)

(72) Inventor: Christopher P. Henderson, High Shincliffe (GB)

(73) Assignee: 3M Innovative Properties Company, St. Paul, MN (US)

( * ) Notice: Subject to any disclaimer, the term of this patent is extended or adjusted under 35 U.S.C. 154(b) by 188 days.

(21) Appl. No.: 15/775,052

(22) PCT Filed: Nov. 8, 2016

(86) PCT No.: PCT/US2016/060966

§ 371 (c)(1),
(2) Date: May 10, 2018

(87) PCT Pub. No.: WO2017/083289

PCT Pub. Date: May 18, 2017

(65) Prior Publication Data

US 2018/0368494 A1 Dec. 27, 2018

Related U.S. Application Data

(60) Provisional application No. 62/253,880, filed on Nov. 11, 2015.

(51) Int. Cl.

| | |
|---|---|
| ***A41D 13/11*** | (2006.01) |
| ***A62B 23/02*** | (2006.01) |
| ***A62B 18/02*** | (2006.01) |

(52) U.S. Cl.

CPC ..... *A41D 13/1161* (2013.01); *A41D 13/1115* (2013.01); *A62B 18/025* (2013.01); *A62B 23/025* (2013.01)

(58) Field of Classification Search

CPC ..... A41D 13/1161; A41D 13/1115; A41D 13/1123; A41D 13/1146; A41D 13/11;
(Continued)

(56) References Cited

U.S. PATENT DOCUMENTS 2,507,447 A * 5/1950 La Joie ..... A45D 44/12 2/174
3,971,369 A * 7/1976 Aspelin ..... A41D 13/1115 128/206.19

(Continued)

FOREIGN PATENT DOCUMENTS

EP 0814871 1/1998
KR 20-0321107 7/2003

(Continued)

OTHER PUBLICATIONS

Davies, "The Separation Of Airborne Dust And Particles", Institution Of Mechanical Engineers, 1952, London, pp. 185-213.

(Continued)

*Primary Examiner* — Jan Christopher L Merene
*Assistant Examiner* — Brian T Khong

(57) ABSTRACT

Various embodiments of a respirator and a method of forming a respirator are disclosed. The respirator can include a mask body having an upper panel, a lower panel, and a central panel disposed between the upper and lower panels. The mask body can also include a left attachment mechanism disposed between a left tab of the mask body and a left portion of at least one of the upper panel and the lower panel when the mask is in an open condition, and a right attachment mechanism disposed between a right tab of the mask body and a right portion of at least one of the upper panel and the lower panel when the mask body is in the open condition.

20 Claims, 4 Drawing Sheets

(58) Field of Classification Search
CPC ..... A41D 13/1169; A41D 13/113; A41D 13/1176; A41D 2400/52; A47D 15/003; A62B 23/025; A62B 23/02; A62B 18/025
See application file for complete search history.

(56) References Cited

U.S. PATENT DOCUMENTS

| | | | | |
|---|---|---|---|---|
| 3,971,373 | A | 7/1976 | Braun | |
| 4,013,816 | A | 3/1977 | Sabee | |
| 4,215,682 | A | 8/1980 | Kubik | |
| RE31,285 | E | 6/1983 | van Turnhout | |
| 4,536,440 | A | 8/1985 | Berg | |
| 4,588,537 | A | 5/1986 | Klaase | |
| 4,790,306 | A | 12/1988 | Braun | |
| 4,798,850 | A | 1/1989 | Brown | |
| 4,807,619 | A | 2/1989 | Dyrud | |
| 4,930,161 | A * | 6/1990 | Cohen | A41D 13/1254 2/114 |
| 5,099,897 | A * | 3/1992 | Curtin | A63B 57/60 150/159 |
| 5,237,986 | A | 8/1993 | Seppala | |
| 5,307,796 | A | 5/1994 | Kronzer | |
| 5,325,892 | A | 7/1994 | Japuntich | |
| 5,394,568 | A | 3/1995 | Brostrom | |
| 5,481,763 | A | 1/1996 | Brostrom | |
| 5,496,507 | A | 3/1996 | Angadjivand | |
| 5,558,089 | A | 9/1996 | Castiglione | |
| 5,617,849 | A | 4/1997 | Springett | |
| 5,656,368 | A | 8/1997 | Braun | |
| 5,804,295 | A | 9/1998 | Braun | |
| 5,906,507 | A * | 5/1999 | Howard | B65H 75/36 174/135 |
| 5,908,598 | A | 6/1999 | Rousseau | |
| D412,573 | S | 8/1999 | Castiglione | |
| D416,323 | S | 11/1999 | Henderson | |
| 6,026,511 | A | 2/2000 | Baumann | |
| 6,041,782 | A | 3/2000 | Angadjivand | |
| 6,123,077 | A | 9/2000 | Bostock | |
| 6,148,817 | A | 11/2000 | Bryant | |
| 6,234,171 | B1 | 5/2001 | Springett | |
| D449,377 | S | 10/2001 | Henderson | |
| 6,332,465 | B1 | 12/2001 | Xue | |
| 6,375,886 | B1 | 4/2002 | Angadjivand | |
| 6,391,429 | B1 | 5/2002 | Senkus | |
| 6,394,090 | B1 | 5/2002 | Chen | |
| 6,397,458 | B1 | 6/2002 | Jones | |
| 6,398,847 | B1 | 6/2002 | Jones | |
| 6,406,657 | B1 | 6/2002 | Eitzman | |
| 6,409,806 | B1 | 6/2002 | Jones | |
| 6,454,986 | B1 | 9/2002 | Eitzman | |
| 6,484,722 | B2 | 11/2002 | Bostock | |
| 6,492,286 | B1 | 12/2002 | Berrigan | |
| RE37,974 | E | 2/2003 | Bowers | |
| 6,536,434 | B1 | 3/2003 | Bostock | |
| 6,561,257 | B2 * | 5/2003 | Huang | B60J 1/2091 160/134 |
| 6,568,392 | B1 | 5/2003 | Bostock | |
| 6,705,317 | B2 | 3/2004 | Castiglione | |
| 6,715,489 | B2 | 4/2004 | Bostock | |
| 6,722,366 | B2 | 4/2004 | Bostock | |
| 6,729,332 | B1 | 5/2004 | Castiglione | |
| 6,743,464 | B1 | 6/2004 | Insley | |
| 6,783,574 | B1 | 8/2004 | Angadjivand | |
| 6,824,718 | B2 | 11/2004 | Eitzman | |
| 6,843,248 | B2 | 1/2005 | Japuntich | |
| 6,854,463 | B2 | 2/2005 | Japuntich | |
| 6,883,518 | B2 | 4/2005 | Mittelstadt | |
| 6,886,563 | B2 | 5/2005 | Bostock | |
| 6,923,182 | B2 | 8/2005 | Angadjivand | |
| 7,013,895 | B2 | 3/2006 | Martin | |
| 7,028,689 | B2 | 4/2006 | Martin | |
| 7,069,930 | B2 | 7/2006 | Bostock | |
| 7,117,868 | B1 | 10/2006 | Japuntich | |
| 7,131,442 | B1 | 11/2006 | Kronzer | |
| RE39,493 | E | 2/2007 | Yuschak | |
| 7,188,622 | B2 | 3/2007 | Martin | |
| 7,302,951 | B2 | 12/2007 | Mittelstadt | |
| 7,311,104 | B2 | 12/2007 | Japuntich | |
| 7,428,903 | B1 | 9/2008 | Japuntich | |
| 8,066,006 | B2 | 11/2011 | Daugaard | |
| D659,821 | S | 5/2012 | Spoo | |
| 8,171,933 | B2 | 5/2012 | Xue | |
| 8,578,515 | B1 * | 11/2013 | Petersen | A41D 11/00 2/69.5 |
| 2001/0067700 | | 7/2001 | Chishti | |
| 2001/0015205 | A1 * | 8/2001 | Bostock | A41D 13/1115 128/206.19 |
| 2004/0078860 | A1 | 4/2004 | Bell | |
| 2005/0051172 | A1 * | 3/2005 | Lee | A41D 13/1161 128/206.19 |
| 2005/0133034 | A1 * | 6/2005 | Jensen | A41D 13/1115 128/206.19 |
| 2006/0180152 | A1 | 8/2006 | Bostock | |
| 2006/0212996 | A1 | 9/2006 | McGrath | |
| 2007/0068529 | A1 | 3/2007 | Kalatoor | |
| 2008/0271737 | A1 * | 11/2008 | Facer | A41D 13/11 128/205.25 |
| 2008/0271739 | A1 * | 11/2008 | Facer | A41D 13/11 128/206.19 |
| 2008/0271740 | A1 * | 11/2008 | Gloag | A41D 13/1123 128/206.28 |
| 2009/0211582 | A1 * | 8/2009 | Reese | A41D 13/1107 128/206.21 |
| 2009/0235934 | A1 * | 9/2009 | Martin | A62B 18/10 128/206.15 |
| 2010/0051032 | A1 | 3/2010 | Kim | |
| 2010/0095967 | A1 | 4/2010 | Bostock | |
| 2010/0154805 | A1 * | 6/2010 | Duffy | A62B 23/025 128/863 |
| 2011/0067700 | A1 | 3/2011 | Spoo | |
| 2011/0155138 | A1 * | 6/2011 | Lin | A41D 13/1115 128/206.19 |
| 2011/0180078 | A1 * | 7/2011 | McKinley | A41D 13/1161 128/863 |
| 2012/0065607 | A1 * | 3/2012 | Konig | A61F 13/5633 604/385.201 |
| 2013/0047995 | A1 * | 2/2013 | Shibata | A41D 13/1115 128/863 |
| 2013/0186414 | A1 * | 7/2013 | Suzuki | A41D 13/1161 128/863 |
| 2014/0182593 | A1 * | 7/2014 | Duffy | A41D 13/1115 128/206.19 |
| 2014/0326245 | A1 * | 11/2014 | Teng | A41D 13/1115 128/206.13 |
| 2014/0326255 | A1 * | 11/2014 | Teng | A41D 13/1115 128/863 |
| 2015/0047574 | A1 * | 2/2015 | Jakubowski | A01K 1/0254 119/499 |
| 2015/0101617 | A1 * | 4/2015 | Duffy | A41D 13/1161 128/863 |
| 2018/0104014 | A1 * | 4/2018 | Heindl | A61B 46/00 |

FOREIGN PATENT DOCUMENTS

| | | |
|---|---|---|
| KR | 20-0348888 | 4/2004 |
| KR | 10-0510164 | 8/2005 |
| KR | 10-0529000 | 11/2005 |
| WO | WO 1996-028216 | 9/1996 |
| WO | WO 2004-028637 | 4/2004 |
| WO | WO 2011-025094 | 3/2011 |

OTHER PUBLICATIONS

Wente, "Superfine Thermoplastic Fibers", Industrial and engineering chemistry, 1956, pp. 1342-1346.
International Search report for PCT International Application No. PCT/US2016/060966 dated Dec. 29, 2016, 2 pages.

* cited by examiner

SHAPE RETAINING FLAT-FOLD RESPIRATOR

CROSS REFERENCE TO RELATED APPLICATIONS

This application is a national stage filing under 35 U.S.C. 371 of PCT/US2016/060966, filed Nov. 8, 2016, which claims the benefit of U.S. Provisional Application No. 62/253,880, filed Nov. 11, 2015, the disclosure of which is incorporated by reference in its/their entirety herein.

BACKGROUND

Respirators are commonly worn over a person's breathing passages in at least one of two situations: (1) to prevent impurities or contaminants from entering the wearer's respiratory system; and (2) to protect other persons or things from being exposed to pathogens and other contaminants exhaled by the wearer. In the first situation, the respirator is worn in an environment where the air contains particles that may be harmful to the wearer, for example, in an auto body shop. In the second situation, the respirator is worn in an environment where there is risk of contamination to other persons or things, for example, in an operating room or clean room.

A variety of respirators have been designed to be used in one or both of these situations. Some of these respirators have been categorized as being "filtering face-pieces" because the mask body itself functions as the filtering mechanism. Unlike respirators that use rubber or elastomeric mask bodies with attachable filter cartridges (see, e.g., U.S. Pat. No. RE39,493 to Yuschak et al.) or insert-molded filter elements (see, e.g., U.S. Pat. No. 4,790,306 to Braun), filtering face-piece respirators are designed to have the filter media cover much of the mask body so that there is no need for installing or replacing a filter cartridge. These filtering face-piece respirators commonly come in one of two configurations: molded respirators and flat-fold respirators.

Molded filtering face-piece respirators often include non-woven webs of thermally-bonded fibers or open-work plastic meshes to furnish the mask body with its cup-shaped configuration. Molded respirators tend to maintain the same shape during both use and storage. These respirators, therefore, cannot be folded flat for storage and shipping. Examples of patents that disclose molded, filtering, face-piece respirators include, e.g., U.S. Pat. No. 7,131,442 to Kronzer et al; U.S. Pat. Nos. 6,923,182 and 6,041,782 to Angadjivand et al.; U.S. Pat. No. 4,807,619 to Dyrud et al.; and U.S. Pat. No. 4,536,440 to Berg.

Flat-fold respirators, as the name implies, can be folded flat for shipping and storage. Such respirators can be opened into a cup-shaped configuration for use. Examples of flat-fold respirators are described, e.g., in U.S. Pat. Nos. 6,568,392 and 6,484,722 to Bostock et al.; and U.S. Pat. No. 6,394,090 to Chen. Some flat-fold respirators have been designed with weld lines, seams, and folds to help maintain their cup-shaped configuration during use. Stiffening members also have been incorporated into panels of the mask body. See, e.g., U.S. Patent Publication Nos. 2001/0067700 and 2010/0154805 to Duffy et al.; and U.S. Design Pat. No. D659,821 to Spoo et al.

Filtering face-piece respirators of the kinds described typically include several different components that are joined or assembled together to make an integral unit. These components may include harnesses, exhalation valves, face seals, nose clips, and the like. For example, face seal components are regularly added because they provide a comfortable fit between differing contours of a wearer's face and the respirator mask body, and also to accommodate dynamic changes that might render the seal ineffective, such as when a wearer's face is moving while the wearer is speaking.

SUMMARY

In general, the present disclosure provides various embodiments of a respirator. The respirator can include a mask body and a harness attached to the mask body. In one or more embodiments, the respirator can also include a left attachment mechanism disposed between a left tab that extends from a central panel of the mask body and a left portion of at least one of an upper panel and a lower panel of the mask body. In one or more embodiments, the respirator can also include at right attachment mechanism disposed between a right tab that extends from a central panel of the mask body and a right portion of at least one of an upper panel and a lower panel of the mask body. One or both of the left and right attachment mechanisms can be adapted to releasably attach the left and right tabs to the left and right portions, respectively, of one or both of the upper and lower panels of the mask body when the mask body is in an open condition. The left and right attachment mechanisms can, in one or more embodiments, aid in maintaining the respirator in the open condition. The tabs optionally include tab portions of the upper panel and lower panel.

In one aspect, the present disclosure provides a respirator that includes a mask body and a harness attached to the mask body. The mask body includes an upper panel, a lower panel, and a central panel disposed between the upper and lower panels. The central panel is separated from the upper panel and the lower panel by first and second lines of demarcation respectively. The mask body further includes a left tab that extends from a left side of the central panel and a right tab that extends from a right side of the central panel. The mask body also includes a left attachment mechanism disposed between the left tab and a left portion of at least one of the upper panel and the lower panel when the mask is in an open condition, where the left attachment mechanism releasably connects the left tab to the left portion of at least one of the upper panel and the lower panel when the mask body is in the open condition. The mask body further includes a right attachment mechanism disposed between the right tab and a right portion of at least one of the upper panel and the lower panel when the mask body is in the open condition, where the right attachment mechanism releasably connects the right tab to the right portion of at least one of the upper panel and the lower panel when the mask body is in the open condition.

In another aspect, the present disclosure provides a method that includes providing a respirator. The respirator includes a mask body that includes an upper panel, a lower panel, and a central panel disposed between the upper and lower panels. The central panel is separated from the upper panel and the lower panel by first and second lines of demarcation respectively. The mask body also includes a left tab that extends from a left side of the central panel, a right tab that extends from a right side of the central panel and, optionally, left tab portions and right tab portions extending from one or both of the upper and lower panels. The method further includes manipulating the upper panel of the respirator from a closed condition to an open condition, and attaching at least one of a left portion of the upper panel to a left tab portion of the upper panel and a right portion of the upper panel to a right tab portion of the upper panel. The method further includes manipulating the lower panel of the respirator from the closed condition to the open condition, and attaching at least one of a left portion of the lower panel to a left tab portion of the lower panel and a right portion of the lower panel to a right tab portion of the lower panel.

All headings provided herein are for the convenience of the reader and should not be used to limit the meaning of any text that follows the heading, unless so specified.

The terms "comprises" and variations thereof do not have a limiting meaning where these terms appear in the description and claims. Such terms will be understood to imply the inclusion of a stated step or element or group of steps or elements but not the exclusion of any other step or element or group of steps or elements.

The words "preferred" and "preferably" refer to embodiments of the disclosure that may afford certain benefits, under certain circumstances; however, other embodiments may also be preferred, under the same or other circumstances. Furthermore, the recitation of one or more preferred embodiments does not imply that other embodiments are not useful, and is not intended to exclude other embodiments from the scope of the disclosure.

In this application, terms such as "a," "an," and "the" are not intended to refer to only a singular entity, but include the general class of which a specific example may be used for illustration. The terms "a," "an," and "the" are used interchangeably with the term "at least one." The phrases "at least one of" and "comprises at least one of" followed by a list refers to any one of the items in the list and any combination of two or more items in the list.

The phrases "at least one of" and "comprises at least one of" followed by a list refers to any one of the items in the list and any combination of two or more items in the list.

As used herein, the term "or" is generally employed in its usual sense including "and/or" unless the content clearly dictates otherwise.

The term "and/or" means one or all of the listed elements or a combination of any two or more of the listed elements.

As used herein in connection with a measured quantity, the term "about" refers to that variation in the measured quantity as would be expected by the skilled artisan making the measurement and exercising a level of care commensurate with the objective of the measurement and the precision of the measuring equipment used. Herein, "up to" a number (e.g., up to 50) includes the number (e.g., 50).

Also herein, the recitations of numerical ranges by endpoints include all numbers subsumed within that range as well as the endpoints (e.g., 1 to 5 includes 1, 1.5, 2, 2.75, 3, 3.80, 4, 5, etc.).

Glossary

The terms set forth herein will have the meanings as defined:

"clean air" means a volume of atmospheric ambient air that has been filtered to remove contaminants;

"closed condition" means that the respirator is in a flat-fold configuration for storage;

"contaminants" means particles (including dusts, mists, and fumes) and/or other substances that generally may not be considered to be particles (e.g., organic vapors, etc.) but which may be suspended in air;

"crosswise dimension" is the dimension that extends laterally across the respirator, from side-to-side when the respirator is viewed from the front;

"cup-shaped configuration" and variations thereof mean any vessel-type shape that is capable of adequately covering the nose and mouth of a wearer;

"disposed between" means at least a portion is disposed between;

"elastic" in reference to a strap of a harness means being able to be stretched at least 100% and return essentially to the original dimension without imparting damage to the strap;

"exterior gas space" means the ambient atmospheric gas space into which exhaled gas enters after passing through and beyond the mask body and/or exhalation valve;

"exterior surface" means the surface of the mask body exposed to ambient atmospheric gas space when the mask body is positioned on the wearer's face;

"face seal" means a part(s) located between the mask body and a wearer's face at one or more locations where the mask body would otherwise contact the face;

"filtering face-piece" means that the mask body itself is designed to filter air that passes through it; there are no separately identifiable filter cartridges or insert-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filter media" means an air-permeable structure that is designed to remove contaminants from air that passes through it;

"filtering structure" means a generally air-permeable construction that filters air; "flat-fold" means that the respirator can be folded flat for storage and opened for use;

"folded inwardly" means being bent back towards the inner surface of the part from which it extends;

"harness" means a structure or combination of parts that assists in supporting the mask body on a wearer's face;

"integral" means being formed together at the same time; that is, being made together as one part and not two separately formed parts that are subsequently joined together;

"interior gas space" means the space between a mask body and a wearer's face;

"interior surface" means the surface of the mask body closest to a wearer's face when the mask body is positioned on the wearer's face;

"joined to" means secured to directly or indirectly;

"line of demarcation" means a fold, seam, weld line, bond line, stitch line, hinge line, and/or any combination thereof;

"mask body" means an air-permeable structure that is designed to fit over the nose and mouth of a wearer and that helps define an interior gas space separated from an exterior gas space (including the seams and bonds that join layers and parts thereof together);

"nose clip" means a mechanical device (other than a nose foam), which device is adapted for use on a mask body to improve the seal at least around a wearer's nose;

"nose region" means the portion of the mask body that resides over a wearer's nose when the respirator is worn;

"open condition" means that the respirator is ready for donning by the wearer;

"perimeter" means the outer edge of the mask body, which outer edge would be disposed generally proximate a wearer's face when the respirator is being donned by a person; a "perimeter segment" is a portion of the perimeter;

"pleat" means a portion that is designed to be or is doubled back upon itself;

"polymeric" and "plastic" each means a material that mainly includes one or more polymers and that may contain other ingredients as well;

"releasably connect" or "releasably connectable" means that two or more elements can be attached together, indirectly or directly, and detached without destroying the elements or affecting the integrity of the elements;

"respirator" means an air filtration device that is worn by a person to provide the wearer with clean air to breathe;

"side" means an area on the mask body distanced from a plane that bisects the mask body centrally and vertically when the mask body is oriented in an upright position and viewed from the front;

"sinus region" means the nose region and parts or areas of the mask body that reside beneath the wearer's eyes and/or eye orbitals when the respirator is being worn in a proper configuration;

"snug fit" or "fit snugly" means that an essentially airtight (or substantially leak-free) fit is provided (between the mask body and the wearer's face);

"strap" means a generally flat elongated structure; and

"transversely extending" means extending generally in the crosswise dimension.

These and other aspects of the present disclosure will be apparent from the detailed description herein. In no event, however, should the above summaries be construed as limitations on the claimed subject matter, which subject matter is defined solely by the attached claims, as may be amended during prosecution.

BRIEF DESCRIPTION OF THE DRAWINGS

Throughout the specification, reference is made to the appended drawings, where like reference numerals designate like elements, and wherein.

DETAILED DESCRIPTION

In general, the present disclosure provides various embodiments of a respirator. The respirator can include a mask body and a harness attached to the mask body. In one or more embodiments, the respirator can also include at least one of a left attachment mechanism disposed between a left tab that extend from a central panel of the mask body and left portions of at least one of an upper panel and a lower panel of the mask body. In one or more embodiments, the respirator can also include at least one of a right attachment mechanism disposed between a right tab that extend from a central panel of the mask body and right portions of at least one of an upper panel and a lower panel of the mask body. One or both of the left and right attachment mechanisms can be adapted to releasably attach the left and right tabs to the left and right portions of one or both of the upper and lower panels of the mask body when the mask body is in an open condition. The left and right attachment mechanisms can, in one or more embodiments, aid in maintaining the respirator in the open condition.

Flat-fold respirators can provide various advantages over molded respirators. For example, flat-fold respirators can be folded flat for compact storage and opened when donned by a wearer. One or more embodiments of flat-fold respirators described herein can include one or more attachment mechanisms that can aid in maintaining a mask body in a cup-shaped configuration or condition when the respirator is donned by the wearer. Such attachment mechanisms can, in one or more embodiments, prevent the mask body from collapsing upon itself, thereby reducing a breathable volume of air within an interior space of the mask body. Further, in one or more embodiments, a respirator that includes one or more of these attachment mechanisms can maintain this cup-like configuration after the wearer removes the respirator from the wearer's face. Maintaining the cup-shaped configuration of the mask body when the respirator is not being worn can allow the wearer to more easily re-fit the respirator on the wearer's face without having to again unfold the mask body.

Figure 1:
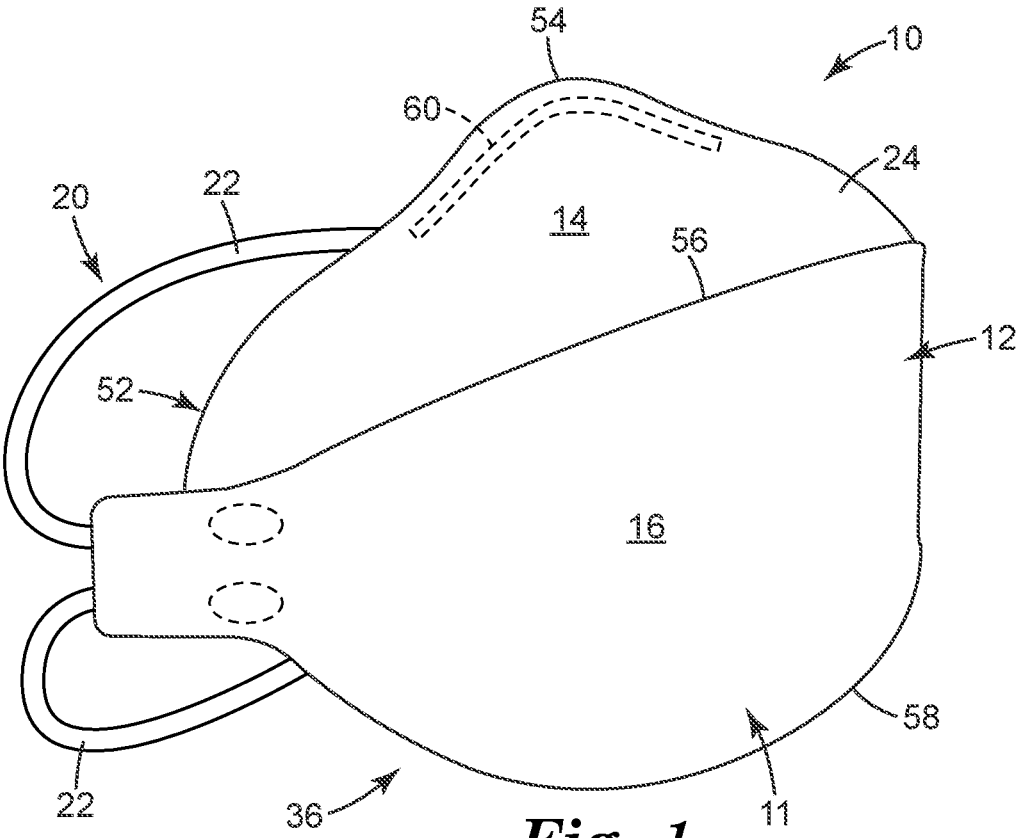
FIG. 1 is a schematic perspective view of one embodiment of a respirator.
Figure 2:
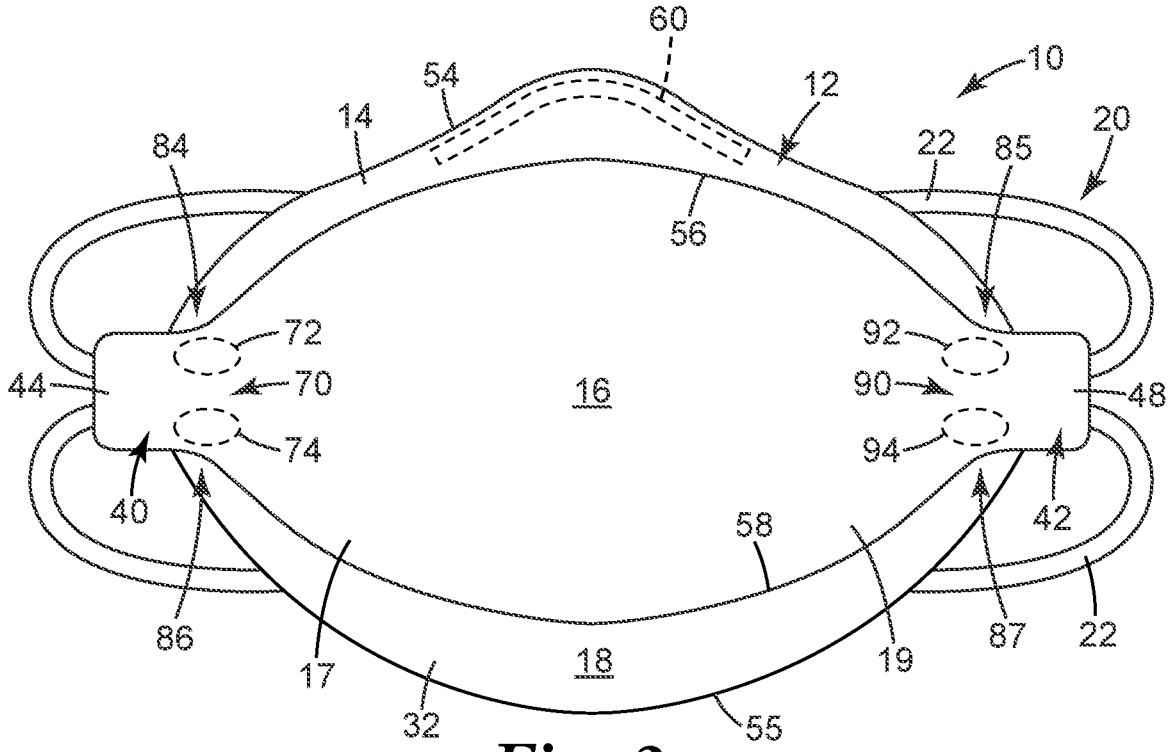
FIG. 2 is a schematic front view of the respirator of FIG. 1.
Figure 3:
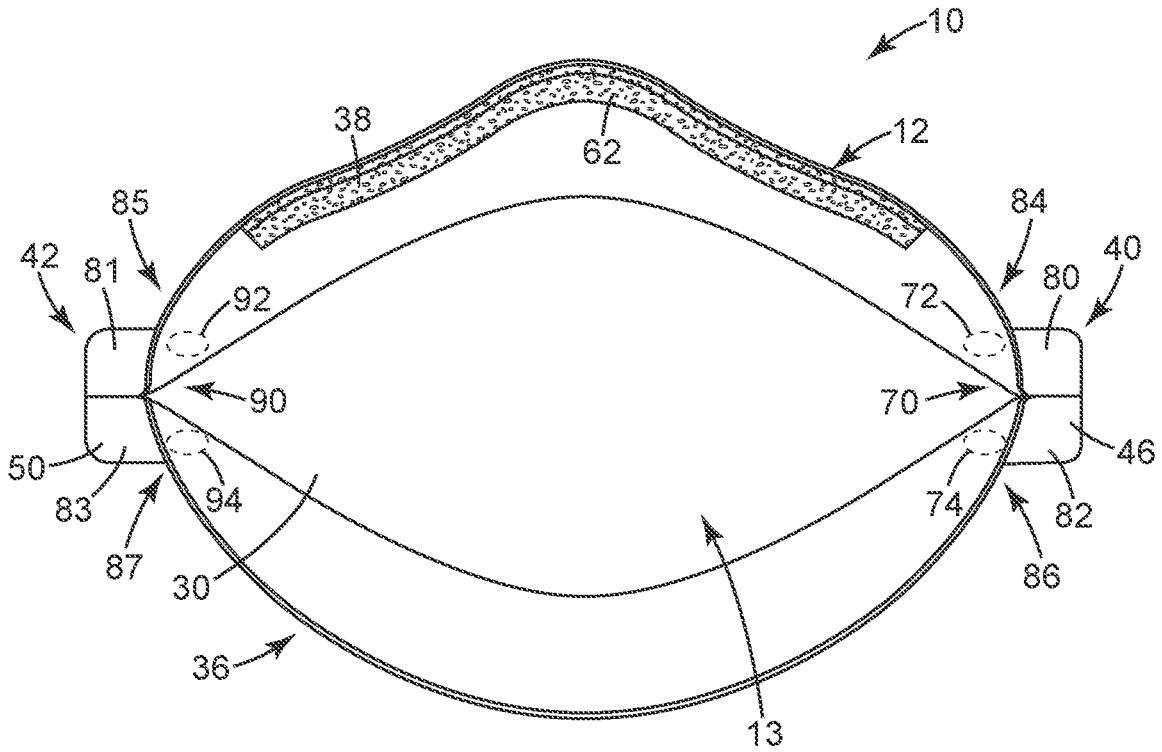
FIG. 3 is a schematic rear view of the respirator of FIG. 1.
Figure 4:
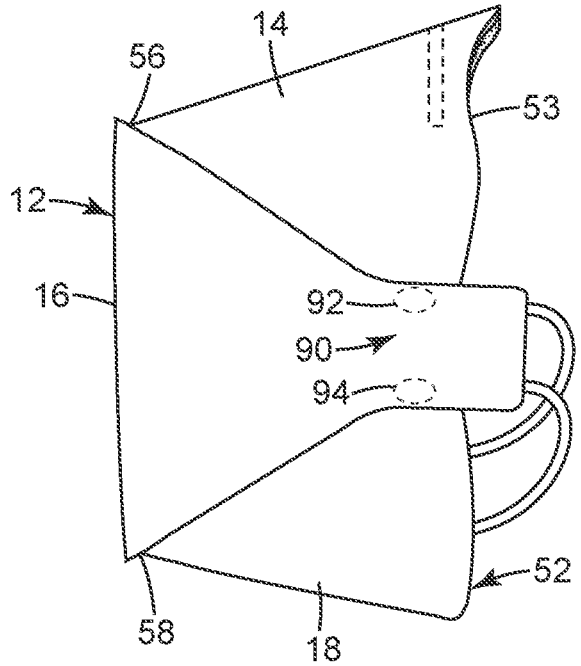
FIG. 4 is a schematic side view of the respirator of FIG. 1.
Figure 5:
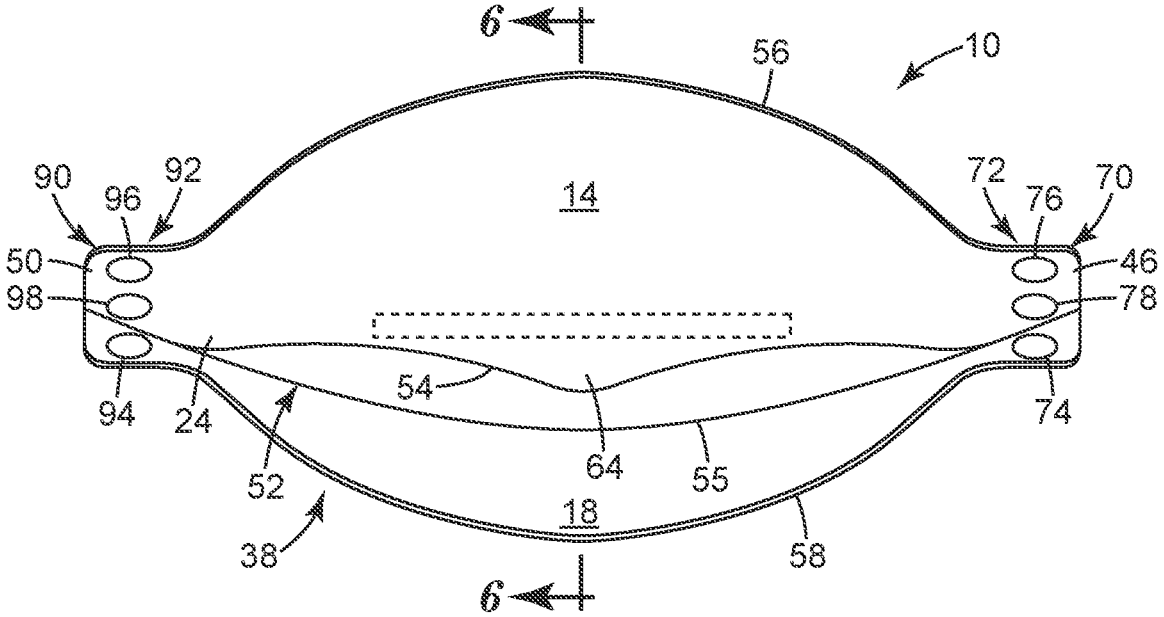
FIG. 5 is a schematic rear view of the respirator of FIG. 1 in a closed condition.

FIGS. 1-9 are various views of one embodiment of a respirator 10. The respirator 10 can include any suitable respirator, e.g., a flat-fold respirator. The respirator 10 can include a mask body 12 and a harness 20 attached to the mask body. The mask body 12 can also include one or more panels and has an exterior surface 11 (FIG. 1) and an interior surface 13 (FIG. 3). The mask body 12 includes an upper panel 14, a central panel 16, and a lower panel 18. The mask body 12 can be adapted to engage a wearer's face at a face-contacting perimeter 52. In one or more embodiments, one or more layers of the mask body 12 can be joined together at the perimeter 52, e.g., by welding, bonding, adhering, stitching, or any other suitable technique.

The central panel 16 can be separated from the upper panel 14 and the lower panel 18 by first and second lines of demarcation 56 and 58. The upper and lower panels 14 and 18 can each be folded inwards towards an interior surface 30 (see, e.g., FIG. 3) of the central panel 16 when the respirator 10 is being folded flat for storage, thereby placing the respirator in a closed condition 38 (see, e.g., closed condition illustrated in FIGS. 5-6). Further, the upper and lower panels 14 and 18 can each be opened outwardly for placement of the respirator 10 on a wearer's face, thereby placing the respirator in an open condition 36 (see, e.g., open condition illustrated in FIGS. 1-4). When the respirator 10 is manipulated from its open condition 36 to its closed condition 38 or vice versa, the upper and lower panels 14 and 18 can at least partially rotate about the first and second lines of demarcation 56 and 58 respectively. In one or more embodiments, the first and second lines of demarcation 56 and 58 can act as first and second hinges or axes, respectfully, for the upper and lower panels 14 and 18.

The mask body 12 also includes a left tab 40 that extends from a left side 17 of the central panel 16, and a right tab 42 that extends from a right side 19 of the central panel. As used herein, the terms "left" and "right" refer to portions or elements of the respirator as viewed by an observer when viewing the respirator as worn by a wearer, e.g., the view illustrated in FIG. 2. Further, the terms "upper" and "lower" refer to portions or elements of the respirator as viewed by the wearer when the respirator is positioned on the wearer's face.

In one or more embodiments, the left and right tabs 40, 42 can provide a region for securement of the harness 20. One exemplary tab is described, e.g., in U.S. Pat. No. D449,377 to Henderson et al. The harness 20 can be any suitable harness and can include one or more straps or elastic bands 22. The straps or bands 22 of harness 20 can be attached to one or both of the left and right tabs 40, 42 using any suitable technique or combination of techniques. For example, the straps or bands 22 can be stapled, welded, adhered, or otherwise secured to the mask body 12 at each opposing tab 40, 42 such that the straps or bands can help to hold the mask body 12 against the face of the wearer when the respirator 10 is being worn. An example of a compression element that could be used to fasten a harness to a mask body using ultrasonic welding is described, e.g., in U.S. Pat. Nos. 6,729,332 and 6,705,317 to Castiglione. The one or more straps or bands 22 can also be welded directly to the mask body 12 without using a separate attachment element. See, e.g., U.S. Pat. No. 6,332,465 to Xue et al. Examples of other harnesses that can be utilized are described, e.g., in U.S. Pat. No. 5,394,568 to Brostrom et al.; U.S. Pat. No. 5,237,986 to Seppala et al.; and in U.S. Pat. No. 5,481,763 to Brostrom et al.

One or both of the left and right tabs 40, 42 can be integral with the mask body 12. For example, in one or more embodiments, one or both of the left and right tabs 40, 42 can be integral with the central panel 16 of the mask body 12. In one or more embodiments, one or both of the left and right tabs 40, 42 can be manufactured separately and then attached to the mask body 12 using any suitable technique or combination of techniques. For example, in one or more embodiments, one or both of the left and right tabs 40, 42 can be manufactured separately and then attached to the central panel 16 of the mask body 12 using an adhesive.

The left and right tabs 40, 42 can include any suitable material or combination of materials. For example, in embodiments where one or both of the left and right tabs 40, 42 are integral with the central panel 16, the left tab can include a left tab portion 44 of the central panel, and the right tab includes a right tab portion 48 of the central panel as shown in FIG. 2. Further, in one or more embodiments, one or both of the left and right tabs 40, 42 can include portions of one or both of the upper panel 14 and the lower panel 18. For example, the left tab 40 can include a left tab portion 80 of the upper panel 14 and a left tab portion 82 of the lower panel 18 as illustrated in FIG. 3. Similarly, the right tab 42 can include a right tab portion 81 of the upper panel 14 and a right tab portion 83 of the lower panel 18. The left tab portions 80, 82 of the upper and lower panels 14, 18 can be attached to the left tab portion 44 of the central panel 16 using any suitable technique or combination of techniques to form the left tab 40. Further, the right tab portions 81, 83 of the upper and lower panels 14, 18 can be attached to the right tab portion 48 of the central panel 16 using any suitable technique or combination of techniques to form the right tab 42.

The perimeter 52 of mask body 12 can include any suitable shape or combination of shapes. In one or more embodiments, the perimeter 52 includes an upper perimeter segment 54 and a lower perimeter segment 55. Further, in one or more embodiments, the perimeter 52 can include one or more concave portions 53 (see e.g., FIG. 4) as is further described, e.g., in U.S. Patent Publication No. 2008/0271739 to Facer et al.

The respirator 10 can also include one or more attachment mechanisms that can assist in maintaining the respirator in a cup-shaped configuration when they respirator is in the open condition 36 as shown in FIGS. 1-4. The one or more attachment mechanisms can be disposed in any suitable location on or in the mask body 12. For example, the respirator 10 can include a left attachment mechanism 70. The left attachment mechanism 70 can be disposed in any suitable location on or in the mask body 12. For example, in one or more embodiments, the left attachment mechanism 70 can be disposed between the left tab 40 and at least one of a left portion 84 of the upper panel 14 and a left portion 86 of the lower panel 18 when the mask body 12 is in the open condition 36 as shown in FIG. 2. The left attachment mechanism 70 can releasably connect the left tab 40 to the left portions 84, 86 of at least one of the upper panel 14 and the lower panel 18.

Further, the respirator 10 can also include a right attachment mechanism 90. The right attachment mechanism 90 can be disposed in any suitable location on or in the mask body 12. In one or more embodiments, the right attachment mechanism 90 can be disposed between the right tab 42 and at least one of a right portion 85 of the upper panel 14 and a right portion 87 of the lower panel 18 when the mask body 12 is in the open condition 36. The right attachment mechanism 90 can releasably connect the right tab 42 to the right portions 85, 87 of at least one of the upper panel 14 and the lower panel 18. While the embodiment illustrated in FIGS. 1-9 includes both left and right attachment mechanisms 70, 90, in one or more embodiments, the respirator 10 can include any suitable number of attachment mechanisms.

The left and right attachment mechanisms 70, 90 can include any suitable attachment device or element. For example, the left attachment mechanism 70 can include an upper fastener 72 disposed between the left portion 84 of the upper panel 14 and the left tab 40. Further, the right attachment mechanism 90 can include an upper fastener 92 disposed between the right portion 85 of the upper panel 14 and the right tab 42. The upper fasteners 72, 92 can include any suitable fastening device or element as is further described herein. In one or more embodiments, one or both of the left and right attachment mechanisms 70, 90 can also include lower fasteners disposed between the left and right tabs 40, 42 respectively and the mask body 12. As illustrated, the left attachment mechanism 70 includes a lower fastener 74 disposed between the left portion 86 of the lower panel 18 and the left tab 40, and the right attachment mechanism 90 includes a lower fastener 94 disposed between the right portion 87 of the lower panel 18 and the right tab 42. While each of the left and right attachment mechanisms 70, 90 includes upper and lower fasteners, the left and right attachment mechanisms can include any suitable number and type of fasteners. In general, the upper and lower fasteners can be disposed in any suitable location on or in the mask body, e.g., on at least one of the tabs, at least one of the upper and lower panels respectively, or on at least one of the tabs and at least one of the upper and lower panels respectively. Furthermore, they may extend through portions of the mask body, e.g., from an outer surface to an interior surface of a panel or tab.

As mentioned herein, each of the fasteners disposed between one or both of the left and right tabs 40, 42 and portions of at least one of the upper and/or lower panels 14, 18 can include any suitable fastening mechanism or element.

Figure 8:
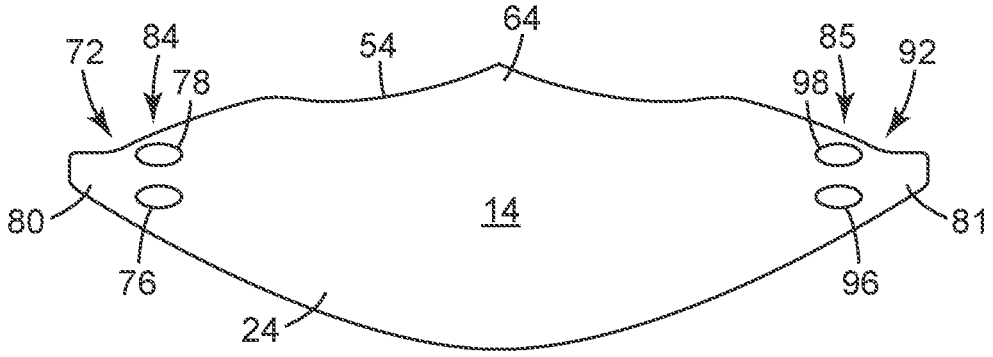
FIG. 8 is a schematic plan view of an upper panel of the respirator of FIG. 1.
Figure 9:
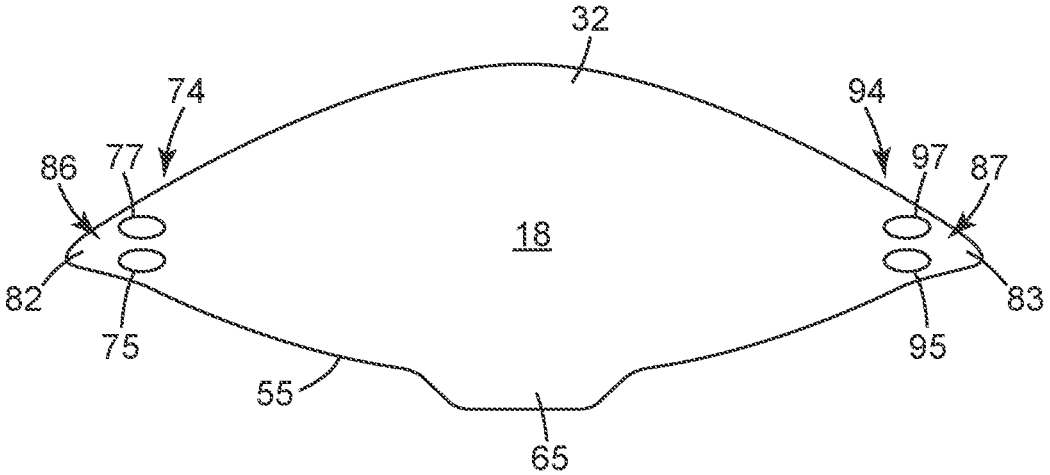
FIG. 9 is a schematic plan view of a lower panel of the respirator of FIG. 1.

For example, FIG. 8 is a schematic plan view of an outer surface 24 of the upper panel 14, and FIG. 9 is a schematic plan view of the outer surface 32 of the lower panel 18. The upper fastener 72 of the left attachment mechanism 70 can include a tab coupling 76 attached to the left tab portion 80 of the upper panel 14, and an upper panel coupling 78 attached to the left portion 84 of the upper panel. The tab coupling 76 is releasably connectable to the upper panel coupling 78. Further, the upper fastener 92 of the right attachment mechanism 90 can include a tab coupling 96 attached to the right tab portion 81 of the upper panel 14, and an upper panel coupling 98 attached to the right portion 85 of the upper panel. The tab coupling 96 is releasably connectable to the upper panel coupling 98.

Further, the lower fastener 74 of the left attachment mechanism 70 can include a tab coupling 77 attached to the left tab portion 82 of the lower panel 18 and a lower panel coupling 75 attached to the left portion 86 of the lower panel. The tab coupling 77 is releasably connectable to the lower panel coupling 75. Further, the lower fastener 94 of the right attachment mechanism 90 includes a tab coupling 97 attached to the right tab portion 83 of the lower panel 18 and a lower panel coupling 95 attached to the right portion 87 of the lower panel. The tab coupling 87 is releasably connectable to the lower panel coupling 95.

As mentioned herein, the upper fasteners 72, 92 and the lower fasteners 74, 94 of the left and right attachment mechanisms 70, 90 can include any suitable attachment device or element, e.g., one or more mechanical fasteners. In one or more embodiments, one or both of the upper fasteners 72, 92 can include a hook and loop fastener. For example, the tab coupling 76 of the upper fastener 72 of the left attachment mechanism 70 can include a hook material disposed on the interior surface 46 of the left tab 40, and the upper panel coupling 78 can include a loop material disposed on the exterior surface 24 of the upper panel 14. In one or more embodiments, one or both of the left upper fastener 72 and the right upper fastener 92 can be adapted such that the tab couplings 76, 96 include a loop material and the upper panel couplings 78, 98 include a hook material. Further, in one or more embodiments, one or both of the lower fasteners 74, 94 of the left and right attachment mechanisms 70, 90 can also include a hook and loop material.

In one or more embodiments, one or both of the upper and lower fasteners of one or both of the left and right attachment mechanisms 70, 90 can include one or more snaps disposed on or in the left tab 40 and/or the right tab 42 and one or both of the upper and lower panels 14, 18. Further, in one or more embodiments, one or both of the upper and lower fasteners of the left and right attachment mechanisms 70, 90 can also include an adhesive, e.g. a repositionable adhesive, that is adapted to releasably connect one or both of the left and right tabs 40, 42 to portions of one or both of the upper panel 14 and the lower panel 18.

In one or more embodiments, at least one of the left and right attachment mechanisms 70, 90 can be integral with the respective tab 40, 42 and at least one of upper and lower panels 14, 18. For example, the interior surfaces 46, 50 of at least one of the left and right tabs 40, 42 can include a hook material that is adapted to be releasably connectable to a material of one or both of the upper and lower panels 14, 18, e.g., one or both of the upper and lower panels can include a loop material. In such embodiments, one or both of the left and right tabs 40, 42 is releasably connectable directly with portions of one or both of the upper and lower panels 14, 18.

Although depicted as being disposed on the left and right tabs 40, 42, one or both of the left and right upper fasteners 72, 92 can be disposed in any suitable location on the mask body 12. For example, one or both of the tab couplings 76, 96 can be disposed in any suitable location on the upper panel 14. Similarly, one or more elements of one or both of the left and right lower fasteners 74, 94 can be disposed in any suitable location on the mask body 12, e.g., on the lower panel 18.

In use, the wearer can manipulate the mask body 12 of the respirator 10 from the closed condition 38 to the open condition 36 using any suitable technique or combination of techniques such that the mask body is in a cup-shaped configuration for wear. For example, the wearer can manipulate the upper panel 14 of the respirator 10 from the closed condition 38 to the open condition 36, e.g., by at least partially rotating the upper panel 14 about the first line of demarcation 56. The wearer can attach portions of the upper panel 14 to one or both of the left and right tabs 40, 42 using any suitable technique or combination of techniques. In one or more embodiments, the wearer can attach at least one of the left portion 84 and the right portion 85 of the upper panel 14 to at least one of the left and right tab portions 80, 81 of the upper panel utilizing one or both of the left and right attachment mechanisms 70, 90. The wearer can manipulate the lower panel 18 of the respirator 10 from the closed condition 38 to the open condition 36, e.g., by at least partially rotating the lower panel about the second line of demarcation 58. The wearer can attach portions of the lower panel 18 to one or both of the left and right tabs 40, 42 using any suitable technique or combination of techniques. For example, in one or more embodiments, the wearer can attach at least one of the left portion 86 and the right portion 87 of the lower panel 18 to at least one of the left and right tab portions 82, 83 of the lower panel utilizing one or both of the left and right attachment mechanisms 70, 90.

The wearer can also manipulate the mask body 12 from the open condition 36 to the closed condition 38 such that the respirator 10 is in a folded configuration, e.g., for storage, using any suitable technique or combination of techniques. For example, the wearer can detach at least one of the left portion 84 of the upper panel 14 from the left tab portion 80 of the upper panel and the right portion 85 of the upper panel from the right tab portion 81. The wearer can manipulate the upper panel 14 from the open condition 36 to the closed condition 38. The wearer can also detach at least one of the left portion 86 of the lower panel 18 from the left tab portion 82 of the lower panel and the right portion 87 of the lower panel from the right tab portion 83 of the lower panel. The wearer can manipulate the bottom panel 18 from the open condition 36 to the closed condition 38.

The various embodiments of respirators described herein can include additional devices or elements to provide, e.g., additional comfort to the user, enhance breathability, improved performance, etc. For example, in one or more embodiments, the mask body 12 can include a nose clip 60 (e.g., FIGS. 1-2). Any suitable nose clip 60 can be utilized. In one or more embodiments, the nose clip 60 may be essentially any additional part that assists in improving the fit over the wearer's nose. Because the wearer's face exhibits a major change in contour in a nose region, a nose clip may be used to better assist in achieving the appropriate fit in this location. The nose clip may include, for example, a pliable dead soft band of metal such as aluminum, which can be shaped to hold the mask in a desired fitting relationship over the nose of the wearer and where the nose meets the cheek. The nose clip may be linear in shape when viewed from a plane projected onto the mask body when in its folded or partially folded condition. Alternatively, the nose clip can be an M-shaped nose clip, an example of which is shown in U.S. Pat. Nos. 5,558,089 and D412,573 to Castiglione. Other exemplary nose clips are described, e.g., in U.S. Pat. No. 8,066,006 to Daigard et al.; U.S. Pat. No. 8,171,933 to Xue et al.; and U.S. Patent Publication No. 2007/0068529A1 to Kalatoor et al.

As shown in FIG. 3, the respirator 10 can also include a nose foam 62 that is disposed on the interior rear surface 13 of the mask body 12 along an inside perimeter of the upper panel 14. The nose foam 62 can extend around the whole perimeter 52 of the mask body and could include a thermochromic fit indicating material that contacts the wearer's face when the mask is worn. Examples of suitable nose foams are shown, e.g., in U.S. Pat. No. 5,617,849 to Springett et al.

The respirator 10 can also include one or more tabs 64 and 65 (FIGS. 8-9) that may assist in opening the mask body 12 from the closed condition 38 to the open condition 36. In one or more embodiments, the mask body 12 can include at least one of an upper tab 64 that extends from a central segment 54 of the perimeter 52 of the upper panel 14, and a lower tab 65 that extends from a central segment 55 of the perimeter of the lower panel 18.

In one or more embodiments, an exhalation valve (not shown) may be attached to the mask body 12 to facilitate purging exhaled air from the interior gas space. The use of an exhalation valve may improve wearer comfort by rapidly removing the warm moist exhaled air from the mask interior. See, e.g., U.S. Pat. Nos. 7,188,622; 7,028,689, and 7,013,895 to Martin et al.; 7,428,903; 7,311,104; 7,117,868; 6,854,463; 6,843,248; and U.S. Pat. No. 5,325,892 to Japuntich et al.; U.S. Pat. Nos. 7,302,951 and 6,883,518 to Mittelstadt et al.; and U.S. Pat. No. RE 37,974 to Bowers. Essentially any exhalation valve that provides a suitable pressure drop and that can be properly secured to the mask body 12 may be used in connection with the present disclosure to rapidly deliver exhaled air from the interior gas space to the exterior gas space.

The mask body 12 can form an enclosed space around the nose and mouth of the wearer and can take on a curved, projected shape that resides in spaced relation to a wearer's face. Flat fold respirators of the present disclosure can be manufactured according to the process described, e.g., in U.S. Pat. Nos. 6,123,077; 6,484,722; 6,536,434; 6,568,392; 6,715, 489; 6,722,366; 6,886,563; 7,069,930; and U.S. Patent Publication No. US2006/0180152A1; and EP0814871B1 to Bostock et al.

Figure 6:
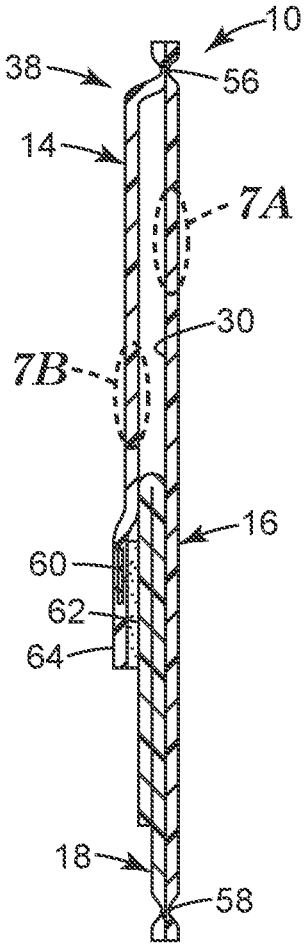
FIG. 6 is a schematic cross-section view of a portion of the respirator of FIG. 1 in the closed condition.
Figure 7A:
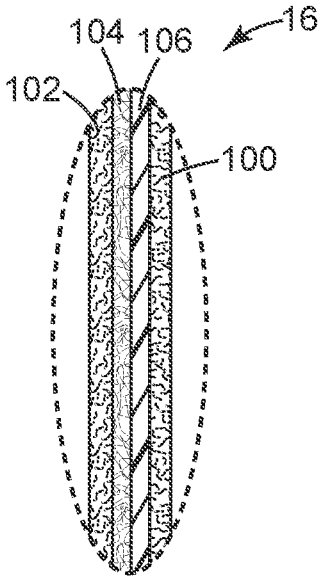
FIG. 7A is a schematic cross-section view of a portion of a mask body of the respirator of FIG. 1.
Figure 7B:
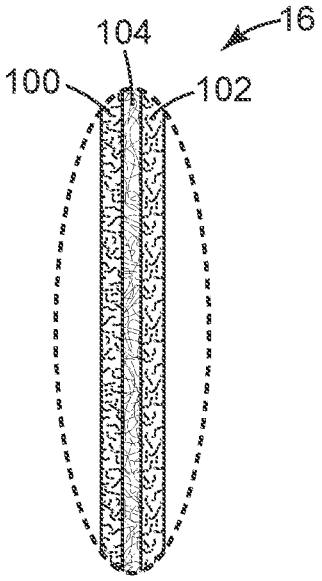
FIG. 7B is a schematic cross-section view of another portion of the mask body of the respirator of FIG. 1.

As shown in FIGS. 6 and 7A-B, the mask body 12 can include a plurality of layers.

These layers may include one or more of an inner cover web 100, and outer cover web 102, a filtration layer 104, and a stiffening layer 106. The layers of the mask body 12 may be joined together at the perimeter 52 using any suitable technique or combination of techniques, including adhesive bonding and ultrasonic welding. Examples of suitable bond patterns are shown, e.g., in U.S. Pat. No. D416,323 to Henderson et al. Descriptions of these various layers and how they may constructed are further described herein. One or more of the various layers may be coextensive with the mask body and extend to the perimeter 52. In one or more embodiments, one or more of these layers may not be coextensive with the mask body 12 such that the particular layer or layers is disposed in a region or portion of the mask body. For example, the stiffening layer 106 is disposed in the upper panel 14 (as shown in FIG. 7A) but not in the central panel 16 (as shown in FIG. 7B). Although not shown, a stiffening layer can also be disposed in the lower panel 18.

The cover webs 100, 102 may be located on the outer sides of the filtration layer 104 to capture any fibers that could come loose therefrom. Typically, the cover webs 100, 102 are made from a selection of fibers that provide a comfortable feel, particularly on a side of the mask body 12 that makes contact with the wearer's face. The constructions of various filtration layers, stiffening layers, and cover webs that may be used in conjunction with a mask body of the present disclosure are described herein in more detail.

Filters that may be beneficially employed in a respirator of the present disclosure are generally low in pressure drop (for example, less than about 195 to 295 Pascals at a face velocity of 13.8 centimeters per second) to minimize the breathing work of the mask wearer. Filtration layers additionally are flexible and have sufficient shear strength so that they generally retain their structure under the expected use conditions. Examples of particle capture filters include one or more webs of fine inorganic fibers (such as fiberglass) or polymeric synthetic fibers. Synthetic fiber webs may include electret-charged polymeric microfibers that are produced from processes such as meltblowing. Polyolefin microfibers formed from polypropylene that has been electrically charged provide particular utility for particulate capture applications.

The filtration layer is typically chosen to achieve a desired filtering effect. The filtration layer generally will remove a high percentage of particles and/or or other contaminants from the gaseous stream that passes through it. For fibrous filter layers, the fibers selected depend upon the kind of substance to be filtered and, typically, are chosen so that they do not become bonded together during the manufacturing operation. As indicated, the filtration layer may come in a variety of shapes and forms and typically has a thickness of about 0.2 millimeters (mm) to 1 centimeter (cm), more typically about 0.3 mm to 0.5 cm, and it could be a generally planar web or it could be corrugated to provide an expanded surface area. See, e.g., U.S. Pat. Nos. 5,804,295 and 5,656,368 to Braun et al. The filtration layer also may include multiple filtration layers joined together by an adhesive or any other techniques. Essentially any suitable material that is known (or later developed) for forming a filtering layer may be used as the filtering material. Webs of melt-blown fibers, such as those taught in Wente, Van A., *Superfine Thermoplastic Fibers,* 48 Indus. Eng. Chem., 1342 et seq. (1956), especially when in a persistent electrically charged (electret) form are especially useful (see, e.g., U.S. Pat. No. 4,215,682 to Kubik et al.). These melt-blown fibers may be microfibers that have an effective fiber diameter less than about 20 micrometers (μm) (referred to as BMF for "blown microfiber"), typically about 1 to 12 μm. Effective fiber diameter may be determined according to Davies, C. N., *The Separation Of Airborne Dust Particles*, Institution Of Mechanical Engineers, London, Proceedings 1B, 1952. Particularly preferred are BMF webs that contain fibers formed from polypropylene, poly(4-methyl-1-pentene), and combinations thereof.

Electrically charged fibrillated-film fibers as taught in U.S. Pat. Re. 31,285 to van Turnhout also may be suitable, as well as rosin-wool fibrous webs and webs of glass fibers or solution-blown, or electrostatically sprayed fibers, especially in microfiber form. Electric charge can be imparted to the fibers by contacting the fibers with water as disclosed in U.S. Pat. No. 6,824,718 to Eitzman et al.; U.S. Pat. No. 6,783,574 to Angadjivand et al.; U.S. Pat. No. 6,743,464 to Insley et al.; U.S. Pat. Nos. 6,454,986 and 6,406,657 to Eitzman et al.; and U.S. Pat. Nos. 6,375,886 and 5,496,507 to Angadjivand et al. Electric charge also may be imparted to the fibers by corona charging as disclosed in U.S. Pat. No. 4,588,537 to Klasse et al., or by tribocharging as disclosed in U.S. Pat. No. 4,798,850 to Brown. Also, additives can be included in the fibers to enhance the filtration performance of webs produced through the hydro-charging process (see U.S. Pat. No. 5,908,598 to Rousseau et al.). Fluorine atoms, in particular, can be disposed at the surface of the fibers in the filter layer to improve filtration performance in an oily mist environment. See, e.g., U.S. Pat. Nos. 6,398,847 B1, 6,397,458 B1, and 6,409,806 B1 to Jones et al. Typical basis weights for electret BMF filtration layers are about 10 to 100 grams per square meter ($g/m^2$). When electrically charged according to techniques described in, e.g., the '507 Angadjivand et al. patent, and when including fluorine atoms as mentioned in the Jones et al. patents, the basis weight may be about 20 to 40 $g/m^2$ and about 10 to 30 $g/m^2$, respectively.

Additionally, sorptive materials such as activated carbon may be disposed between the fibers and/or various layers that include the filtering structure. Further, separate particulate filtration layers may be used with sorptive layers to provide filtration for both particulates and vapors. The sorbent component may be used for removing hazardous or odorous gases from the breathing air. Sorbents may include powders or granules that are bound in a filter layer by adhesives, binders, or fibrous structures. See, e.g., U.S. Pat. No. 6,234,171 to Springett et al. and U.S. Pat. No. 3,971,373 to Braun. A sorbent layer can be formed by coating a substrate, such as fibrous or reticulated foam, to form a thin coherent layer. Sorbent materials may include activated carbons that are chemically treated or not, porous alumna-silica catalyst substrates, and alumna particles. An example of a sorptive filtering structure that may be conformed into various configurations is described in U.S. Pat. No. 6,391,429 to Senkus et al.

The cover webs also may have filtering abilities, although typically not nearly as good as the filtering layer and/or may serve to make a filtering face-piece respirator more comfortable to wear. The cover webs may be made from non-woven fibrous materials such as spun bonded fibers that contain, e.g., polyolefins, and polyesters. See, e.g., U.S. Pat. No. 6,041,782 to Angadjivand et al.; U.S. Pat. No. 4,807,619 to Dyrud et al.; and U.S. Pat. No. 4,536,440 to Berg. When a wearer inhales, air is drawn through the mask body, and airborne particles become trapped in the interstices between the fibers, particularly the fibers in the filter layer.

The inner cover web can be used to provide a smooth surface for contacting the wearer's face. Further, the outer cover web, in addition to providing splash fluid protection, can be used for entrapping loose fibers in the mask body and for aesthetic reasons. The cover web typically does not provide any substantial filtering benefits to the filtering structure, although it can act as a pre-filter when disposed on the exterior of (or upstream to) the filtration layer. To obtain a suitable degree of comfort, an inner cover web can have a comparatively low basis weight and can be formed from comparatively fine fibers. More particularly, the cover web may be fashioned to have a basis weight of about 5 to 70 $g/m^2$ (typically 10 to 30 $g/m^2$), and the fibers may be less than 3.5 denier (typically less than 2 denier, and more typically less than 1 denier but greater than 0.1 denier). Fibers used in the cover web often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Suitable materials for the cover web may be blown microfiber (BMF) materials, particularly polyolefin BMF materials, e.g., polypropylene BMF materials (including polypropylene blends and also blends of polypropylene and polyethylene). And an exemplary process for producing BMF materials for a cover web is described in U.S. Pat. No. 4,013,816 to Sabee et al. The web may be formed by collecting the fibers on a smooth surface, typically a smooth-surfaced drum or a rotating collector. See, e.g., U.S. Pat. No. 6,492,286 to Berrigan et al. Spun-bond fibers also may be used.

A typical cover web may be made from polypropylene or a polypropylene/polyolefin blend that contains 50 weight percent or more polypropylene. These materials have been found to offer high degrees of softness and comfort to the wearer and also, when the filter material is a polypropylene BMF material, to remain secured to the filter material without requiring an adhesive between the layers. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. One example of a fiber for the cover web is a polypropylene BMF made from the polypropylene resin "ESCORENE™ 3505G" from EXXON Corporation, providing a basis weight of about 25 $g/m^2$ and having a fiber denier in the range 0.2 to 3.1 (with an average, measured over 100 fibers of about 0.8). Another suitable fiber is a polypropylene/polyethylene BMF (produced from a mixture comprising 85% of the resin "ESCORENE™ 3505G" and 15 percent of the ethylene/alpha-olefin copolymer "EXACT™ 4023" also from EXXON Corporation) providing a basis weight of about 25 $g/m^2$ and having an average fiber denier of about 0.8. Suitable spunbond materials are available under the trade designations "COROSOFT™ PLUS 20," "COROSOFT™ CLASSIC 20" AND "COROVIN™ PP S 14," from COROVIN GmbH of Peine, Germany, and a carded polypropylene/viscose material available, under the trade designation "370/15," from J. W. SUOMINEN OY of Nakila, Finland. Cover webs typically have very few fibers protruding from the web surface after processing and therefore have a smooth outer surface. Examples of cover webs that may be used in a respirator of the present disclosure are described, e.g., in U.S. Pat. No. 6,041,782 to Angadjivand; U.S. Pat. No. 6,123,077 to Bostock et al.; and PCT Publication No. WO 96/28216A to Bostock et al.

In one or more embodiments, one or both of the inner cover web 100 and outer cover web 102 can include a polymeric netting. Any suitable polymeric netting can be utilized for one or both cover webs. The netting may be made from a variety of polymeric materials. Polymers suitable for netting formation are thermoplastic materials. Examples of thermoplastic polymers that can be used to form polymer netting of the present invention include polyolefins (e.g., polypropylene and polyethylene), polyethylene-vinyl acetate (EVA), polyvinyl chloride, polystyrene, nylons, polyesters (e.g., polyethylene terephthalate), and elastomeric polymers, (e.g., ABA block copolymers, polyurethanes, polyolefin elastomers, polyurethane elastomers, metallocene polyolefin elastomers, polyamide elastomers, ethylene vinyl acetate elastomers, and polyester elastomers). Blends of two or more materials also may be used in the manufacture of nettings. Examples of such blends include polypropylene/EVA and polyethylene/EVA. Polypropylene may be preferred for use in the polymeric netting since melt-blown fibers are regularly made from polypropylene. Use of similar polymers enables proper welding of the support structure to the filtering structure.

The stiffening layer(s) may be formed from at least one layer of fibrous material that can be molded to the desired shape with the use of heat and that retains its shape when cooled. Shape retention is typically achieved by causing the fibers to bond to each other at points of contact between them, for example, by fusion or welding. Any suitable material known for making a shape-retaining layer of a direct-molded respiratory mask may be used to form the mask shell, including, for example, a mixture of synthetic staple fiber, e.g., crimped, and bicomponent staple fiber. Bicomponent fiber is a fiber that includes two or more distinct regions of fibrous material, typically distinct regions of polymeric materials. Typical bicomponent fibers include a binder component and a structural component. The binder component allows the fibers of the shape-retaining shell to be bonded together at fiber intersection points when heated and cooled. During heating, the binder component flows into contact with adjacent fibers. The shape-retaining layer can be prepared from fiber mixtures that include staple fiber and bicomponent fiber in a weight-percent ratios that may range, for example, from 0/100 to 75/25. In one or more embodiments, the material includes at least 50 weight-percent bicomponent fiber to create a greater number of intersection bonding points, which, in turn, increase the resilience and shape retention of the shell.

Suitable bicomponent fibers that may be used in the shaping layer include, for example, side-by-side configurations, concentric sheath-core configurations, and elliptical sheath-core configurations. One suitable bicomponent fiber is the polyester bicomponent fiber available, under the trade designation "KOSA T254" (12 denier, length 38 mm), from KOSA of Charlotte, N.C., U.S.A., which may be used in combination with a polyester staple fiber, for example, that is available from KOSA under the trade designation "T259" (3 denier, length 38 mm) and possibly also a polyethylene terephthalate (PET) fiber, for example, that available from KOSA under the trade designation "T295" (15 denier, length 32 mm). Alternatively, the bicomponent fiber may include a generally concentric sheath-core configuration having a core of crystalline PET surrounded by a sheath of a polymer formed from isophthalate and terephthalate ester monomers. The latter polymer is heat softenable at a temperature lower than the core material. Polyester has advantages in that it can contribute to mask resiliency and can absorb less moisture than other fibers.

Alternatively, the stiffening layer can be prepared without bicomponent fibers. For example, fibers of a heat-flowable polyester can be included together with, e.g., stapled, crimped, fibers in a shaping layer so that, upon heating of the web material, the binder fibers can melt and flow to a fiber intersection point where it forms a mass that upon cooling of the binder material, creates a bond at the intersection point. Staple fibers (for the shaping component) that are pre-treated with Ammonium Polyphosphate type intumescent FR agents may be used in connection with the present disclosure in addition to or in lieu of a spray-application of the agent. Having the staple fibers contain, or, otherwise being treated with, the agent and then formed into a shell (using binder fibers to hold it together) would be another pathway to employ the agents.

When a fibrous web is used as the material for the shape-retaining shell, the web can be conveniently prepared on a RANDO WEBBER® air-laying machine (available from Rando Machine Corporation, Macedon, N.Y.) or a carding machine. The web can be formed from bicomponent fibers or other fibers in conventional staple lengths suitable for such equipment. To obtain a shape-retaining layer that has the required resiliency and shape-retention, the layer can have a basis weight of at least about 100 g/m$^2$, although lower basis weights are possible. Higher basis weights, for example, approximately 150 or more than 200 g/m$^2$, may provide greater resistance to deformation and greater resiliency and may be more suitable if the mask body is used to support an exhalation valve. Together with these minimum basis weights, the shaping layer typically has a maximum density of about 0.2 g/cm$^2$ over the central area of the mask. Typically, the shaping layer would have a thickness of about 0.3 to 2.0, more typically about 0.4 to 0.8 millimeters. Examples of shaping layers suitable for use in the present disclosure are described, e.g., U.S. Pat. No. 5,307,796 to Kronzer et al.; U.S. Pat. No. 4,807,619 to Dyrud et al.; and 4,536,440 to Berg. Staple fibers (for the shaping component) that are pre-treated with Ammonium Polyphosphate type intumescent FR agents may be used in connection with the present disclosure in addition to or in lieu of a spray-application of the agent. Having the staple fibers contain, or, otherwise being treated with, the agent and then formed into a shell (using binder fibers to hold it together) would be another pathway to employ the agents.

The various embodiments of respirators described herein can be manufactured using any suitable technique or combination of techniques. See, e.g., U.S. Pat. No. 6,148,817 to Bryant et al.; U.S. Pat. No. 6,722,366 to Bostock et al.; and U.S. Pat. No. 6,394,090 to Chen et al. In general, a flat-folded respirator, e.g., respirator 10, can be formed from a single piece, although multiple pieces can be attached to one another using the various techniques described herein, such as a batch process (e.g., by plunge welding) or a continuous process (e.g., rotary welding). In either process, a flat-folded respirator can be manufactured by forming a substantially flat sheet of a multilayer construction (also referred to herein as a "mask body blank") by bonding and cutting the outer forming edges. Other techniques may be employed for forming the edges utilizing other techniques, such as ultrasonic welding, stitching, and the application of pressure to form the edges (with or without the addition of heat).

All references and publications cited herein are expressly incorporated herein by reference in their entirety into this disclosure, except to the extent they may directly contradict this disclosure. Illustrative embodiments of this disclosure are discussed and reference has been made to possible variations within the scope of this disclosure. These and other variations and modifications in the disclosure will be apparent to those skilled in the art without departing from the scope of the disclosure, and it should be understood that this disclosure is not limited to the illustrative embodiments set forth herein. Accordingly, the disclosure is to be limited only by the claims provided below.

What is claimed is:

1. A respirator comprising a mask body and a harness attached to the mask body, wherein the mask body comprises:

an upper panel, a lower panel, and a central panel disposed between the upper and lower panels, wherein the central panel is separated from the upper panel and the lower panel by first and second lines of demarcation respectively;

a left tab that extends from a left side of the central panel and a right tab that extends from a right side of the central panel;

a left attachment mechanism disposed between the left tab and a left portion of the upper panel and the lower panel when the mask body is in an open condition, wherein the left attachment mechanism releasably connects the left tab to the left portion of the upper panel and the lower panel when the mask body is in the open condition; and a right attachment mechanism disposed between the right tab and a right portion of the upper panel and the lower panel when the mask body is in the open condition, wherein the right attachment mechanism releasably connects the right tab to the right portion of the upper panel and the lower panel when the mask body is in the open condition;

wherein the left attachment mechanism comprises an upper fastener disposed between the left portion of the upper panel and left tab, and the right attachment mechanism comprises an upper fastener disposed between the right portion of the upper panel and the right tab, and further wherein the left attachment mechanism further comprises a lower fastener disposed between the left portion of the lower panel and the left tab, and the right attachment mechanism further comprises a lower fastener disposed between the right portion of the lower panel and the right tab; and wherein the mask body is adapted to be manipulated between a closed condition and the open condition, wherein the upper fastener of the left attachment mechanism comprises a tab coupling attached to a left tab portion of the upper panel and an upper panel coupling attached to the left portion of the upper panel, and wherein the upper fastener of the right attachment mechanism comprises a tab coupling attached to a right tab portion of the upper panel and an upper panel coupling attached to the right portion of the upper panel, wherein when a wearer manipulates the mask body from the closed condition to the open condition, the wearer releasably connects the tab coupling to the upper panel coupling of the upper fastener of the left attachment mechanism and the wearer releasably connects the tab coupling to the upper panel coupling of the upper fastener of the right attachment mechanism such that the mask body is in a cup-shaped configuration in the open condition and places the cup-shaped mask body on the wearer, wherein when the wearer removes the mask body from the wearer and the mask body maintains the cup-shaped configuration in the open condition due to the connection between the tab coupling and the upper panel coupling of the upper fastener of the left attachment mechanism and the connection between the tab coupling to the upper panel coupling of the upper fastener of the right attachment mechanism.

2. The respirator of claim 1, wherein the lower fastener of the left attachment mechanism comprises a tab coupling attached to a left tab portion of the lower panel and a lower panel coupling attached to the left portion of the lower panel, and wherein the lower fastener of the right attachment mechanism comprises a tab coupling attached to a right tab portion of the lower panel and a lower panel coupling attached to the right portion of the lower panel.

3. The respirator of claim 1, wherein at least one of the upper and lower fasteners of the left attachment mechanism comprises a hook-and-loop fastener.

4. The respirator of claim 1, wherein at least one of the upper and lower fasteners of the right attachment mechanism comprises a hook-and-loop fastener.

5. The respirator of claim 1, wherein at least one of the upper and lower fasteners of the left attachment mechanism comprises a snap.

6. The respirator of claim 1, wherein at least one of the upper and lower fasteners of the right attachment mechanism comprises a snap.

7. The respirator of claim 1, wherein at least one of the upper and lower fasteners of the left attachment mechanism comprises an adhesive.

8. The respirator of claim 1, wherein at least one of the upper and lower fasteners of the right attachment mechanism comprises an adhesive.

9. The respirator of claim 1, wherein the mask body further comprises inner and outer cover webs and a filtration layer disposed between the inner and outer cover webs.

10. The respirator of claim 1, wherein the upper panel is at least partially rotatable about the first line of demarcation.

11. The respirator of claim 1, wherein the lower panel is at least partially rotatable about the second line of demarcation.

12. The respirator of claim 11, wherein the mask body is adapted to be manipulated between the closed condition and the open condition, wherein the upper and lower panels are adapted to be folded inward towards an inner surface of the central panel when the mask is in the closed condition.

13. The respirator of claim 1, wherein the harness is attached to the left and right tabs.

14. The respirator of claim 1, wherein the mask body further comprises an upper tab that extends from a central segment of a perimeter of the upper panel, and a lower tab that extends from a central segment of a perimeter of the lower panel.

15. The respirator of claim 1, wherein the left and right tabs are integral to the central panel.

16. The respirator of claim 1, wherein when the mask body is in the closed condition, the mask body is in a flat folded configuration.

17. A method comprising:

providing a respirator comprising:

a mask body that comprises an upper panel, a lower panel, and a central panel disposed between the upper and lower panels, wherein the central panel is separated from the upper panel and the lower panel by first and second lines of demarcation respectively;

a left tab that extends from a left side of the central panel and a right tab that extends from a right side of the central panel;

a left attachment mechanism disposed between the left tab and a left portion of the upper panel and the lower panel when the mask body is in an open condition, wherein the left attachment mechanism releasably connects the left tab to the left portion of the upper panel and the lower panel when the mask body is in the open condition; and a right attachment mechanism disposed between the right tab and a right portion of the upper panel and the lower panel when the mask body is in the open condition, wherein the right attachment mechanism releasably connects the right tab to the right portion of the upper panel and the lower panel when the mask body is in the open condition;

wherein the left attachment mechanism comprises an upper fastener disposed between the left portion of the upper panel and left tab, and the right attachment mechanism comprises an upper fastener disposed between the right portion of the upper panel and the right tab, and further wherein the left attachment mechanism further comprises a lower fastener disposed between the left portion of the lower panel and the left tab, and the right attachment mechanism further comprises a lower fastener disposed between the right portion of the lower panel and the right tab;

wherein the upper fastener of the left attachment mechanism comprises a tab coupling attached to a left tab portion of the upper panel and an upper panel coupling attached to the left portion of the upper panel, and wherein the upper fastener of the right attachment mechanism comprises a tab coupling attached to a right tab portion of the upper panel and an upper panel coupling attached to the right portion of the upper panel, and a harness attached to the mask body;

manipulating the upper panel of the respirator from a closed condition to an open condition by attaching the tab coupling to the upper panel coupling of the upper fastener of the left attachment mechanism and attaching the tab coupling to the upper panel coupling of the upper fastener of the right attachment mechanism;

manipulating the lower panel of the respirator from the closed condition to the open condition by attaching at least one of a left portion of the lower panel to a left tab portion of the lower panel and a right portion of the lower panel to a right tab portion of the lower panel;

placing the mask body in a cup-shaped configuration in the open condition on a wearer; and removing the mask body from the wearer and thereafter maintaining the mask body in the cup-shaped configuration in the open condition due to attachment between the tab coupling and the upper panel coupling of the upper fastener of the left attachment mechanism and the attachment between the tab coupling to the upper panel coupling of the upper fastener of the right attachment mechanism.

18. The method of claim 17, wherein manipulating the upper panel comprises at least partially rotating the upper panel about the first line of demarcation, and further wherein manipulating the lower panel comprises at least partially rotating the lower panel about the second line of demarcation.

19. The method of claim 17, further comprising:

detaching at least one of the left portion of the upper panel from the left tab portion of the upper panel and the right portion of the upper panel from the right tab portion of the upper panel;

manipulating the upper panel from the open condition to the closed condition;

detaching at least one of the left portion of the lower panel from the left tab portion of the lower panel and the right portion of the lower panel from the right tab portion of the lower panel; and manipulating the lower panel from the open condition to the closed condition.

20. The method of claim 17, wherein when the mask body is in the closed condition, the mask body is in a flat folded configuration.

* * * * *